United States Patent [19]

Colvin

[11] Patent Number: 4,930,378

[45] Date of Patent: Jun. 5, 1990

[54] WRENCH OPENING ENGAGEMENT SURFACE CONFIGURATION

[75] Inventor: David S. Colvin, 23922 Haynes, Farmington Hills, Mich. 48024

[73] Assignee: David S. Colvin, Farmington Hills, Mich.

[21] Appl. No.: 446,651

[22] Filed: Dec. 6, 1989

Related U.S. Application Data

[63] Continuation of Ser. No. 185,042, Apr. 22, 1988.

[51] Int. Cl.[5] ..... B25B 13/06

[52] U.S. Cl. ..... 81/121.1

[58] Field of Search ..... 81/119, 121.1, 124.3, 81/124.6, 124.7

[56] References Cited

U.S. PATENT DOCUMENTS

| | | |
|---|---|---|
| 736,687 | 8/1903 | Chandler . |
| 1,954,141 | 4/1934 | Miquelon . |
| 2,652,735 | 9/1953 | Wilder . |
| 2,685,219 | 8/1954 | Diebold . |
| 2,692,522 | 10/1954 | Reyner . |
| 3,125,910 | 3/1964 | Kavalar . |
| 3,242,775 | 3/1966 | Hinkle . |
| 3,466,956 | 9/1969 | Bowers . |
| 3,495,485 | 2/1970 | Knudsen et al. . |
| 3,577,817 | 5/1971 | Smith et al. . |
| 3,695,124 | 10/1972 | Myers . |
| 3,903,764 | 9/1975 | Andersen . |
| 3,908,488 | 9/1975 | Andersen . |
| 4,253,353 | 3/1981 | Symbol . |
| 4,512,220 | 4/1985 | Barnhill et al. . |
| 4,581,957 | 4/1986 | Dossier . |

*Primary Examiner*—D. S. Meislin

*Attorney, Agent, or Firm*—Brooks & Kushman

[57] ABSTRACT

A wrench of either a socket or closed-end type is disclosed as including a closed wrench opening (**30, 30*a*, 30′, 130 130*a*, 130′, 230, 230′) having curved engagement surfaces that connect associated pairs of flat surfaces. The curved engagement surfaces engage a conventionally toleranced hexagonal fastener without any engagement thereof by the flat surfaces. In one embodiment, the wrench opening (30, 30*a*, 30′, 230) has a "six-point" construction including six circumferentially extending flat surfaces and six pairs of angularly oriented flat surfaces. In another "twelve-point" embodiment, the wrench opening (130, 130*a*, 130′, 230**) has twelve pairs of angularly oriented flat surfaces connected by the curved engagement surfaces. Connecting surfaces of the wrench opening connect the flat surfaces in both the "six-point" and "twelve-point" versions. The curvature of the engagement surfaces preferably has a specified relationship with respect to the size of the wrench opening and with respect to the connecting surfaces which are also curved, and the preferred angularlity of the flat surfaces with respect to the wrench opening is also specified.

34 Claims, 6 Drawing Sheets

Fig. 1
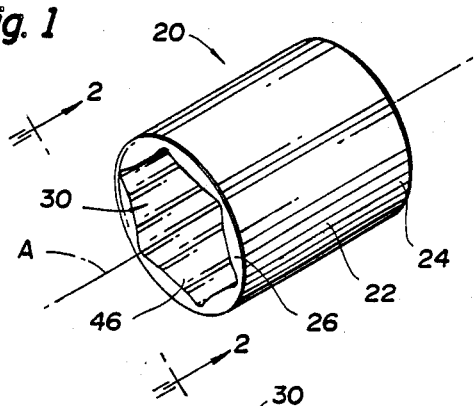
Fig. 2
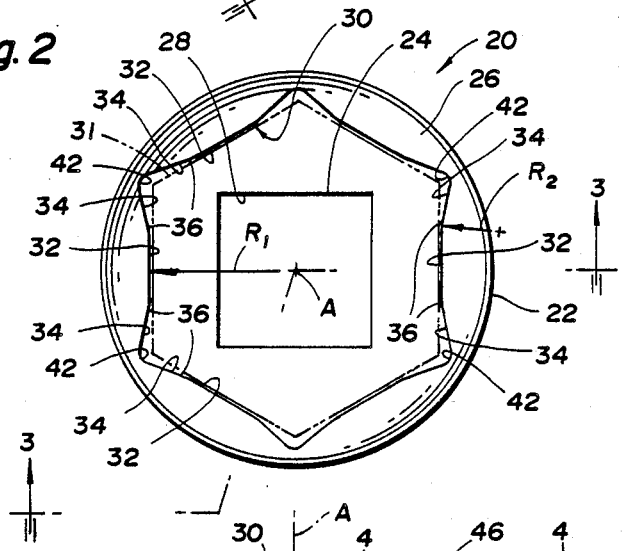
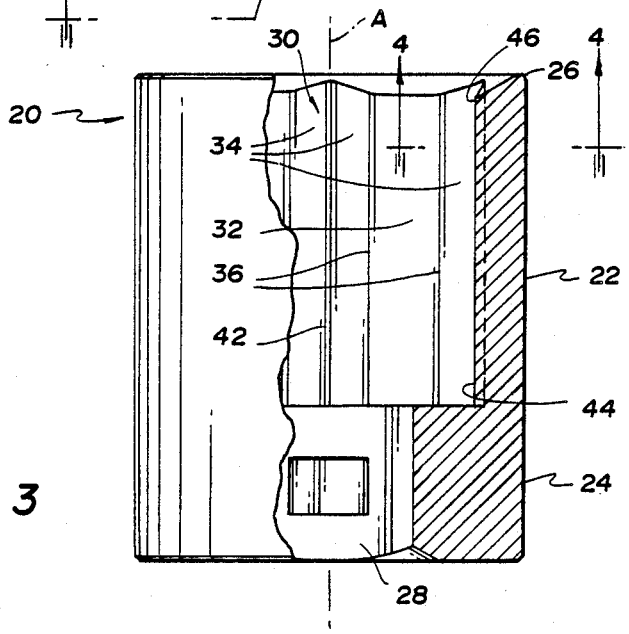
Fig. 3

WRENCH OPENING ENGAGEMENT SURFACE CONFIGURATION

CROSS REFERENCED TO RELATED APPLICATION

This application is a continuation of pending prior application Ser. No. 185,042 filed on Apr. 22, 1988 pending 1/22/90 in the name of David S. Colvin for Wrench Opening Engagement Surface Configuration.

TECHNICAL FIELD

This invention relates to a wrench including a body defining a closed wrench opening having an engagement surface configuration for torquing hexagonal fasteners such as nuts or bolt heads.

BACKGROUND ART

Wrenches having closed wrench openings conventionally include planar engagement surfaces for engaging each side of a hexagonal fastener to be torqued. Usually such planar engagement surfaces are arranged either in a hexagonal arrangement that is conventionally referred to as a "six-point" opening or, alternatively, in a double hexagonal arrangement that is conventionally referred to as a "twelve-point" opening. In either case, conventional tolerances used by manufacturers of hexagonal fasteners and wrenches result in some tolerance spacing between the planar engagement surfaces at the wrench opening and the sides of a hexagonal fastener to be torqued. Such spacing results in a certain amount of "free swing" that will vary depending upon the size of each particular wrench opening and hexagonal fastener received by the wrench opening. The net result is that the pointed line junctions between the flat sides of the hexagonal fastener are engaged by the planar engagement surfaces of the wrench opening applying the torque. This line contact amplifies the stress applied to the hexagonal fastener and thereby results in deformation of the fastener and less torquing ability than would be the case if the stress were distributed by surface-to-surface engagement.

In attempting to overcome the above-mentioned problems, prior art closed wrench openings have included angularly oriented planar engagement surface portions whose angularity is selected in attempt to provide surface-to-surface engagement with the engagement with the hexagonal fastener when the average tolerance spacing is present. See specifically the U.S. Pat. No. 3,242,775 of Hinkle wherein this surface-to-surface engagement is provided by deformation of the hexagonal fastener by the angular junction of the planar engagement surface portions of the wrench opening. Such deformation of the hexagonal fastener necessarily limits its useful lifetime. Other wrenches having closed wrench openings with angularly oriented planar engagement surface portions are disclosed by U.S. Pat. Nos.: 3,466,956 Bowers; 3,495,485 Knudsen et al; 3,903,764 Andersen; 3,908,488 Andersen; and 4,512,220 Barnhill, III et al.

Wrenches having closed wrench openings with curved engagement surfaces are desirable from the standpoint of increasing the surface-to-surface contact with the hexagonal fastener being torqued. However, in the past, such wrench openings have always had at least one of the ends thereof connected to another curved surface which has made it difficult and relatively expensive to manufacture the wrench openings. Such wrench openings are disclosed by U.S. Patent Nos.: 3,125,910 Kavalar; 3,695,124 Myers; and 4,581,957 Dossier.

Other wrenches are disclosed by U.S. Pat. Nos.: 736,687 Chandler; 1,954,141 Miquelon; 2,652,735 Wilder; 2,685,219 Diebold; 2,692,522 Reyner; 3,577,817 Smith; and 4,253,353 Symbol.

DISCLOSURE OF INVENTION

An object of the present invention is to provide a wrench having a closed wrench opening of an improved construction for providing surface-to-surface contact with a conventionally toleranced hexagonal fastener such as a nut or bolt head of the same nominal size. In carrying out this object and other objects of the invention, the wrench opening is easier and less expensive to manufacture than prior art wrench openings having curved engagement surfaces. The wrench opening of this invention also has the capability of facilitating insertion over the hexagonal fastener while still providing close tolerance gripping thereof with minimal "free swing" during torquing of the fastener.

Each embodiment of the wrench of body defining a closed wrench opening that has a central axis and is of a nominal size for torquing a conventionally toleranced hexagonal fastener such as a nut or bolt head of the same nominal size.

In one embodiment, the wrench opening is of a "six-point" construction and has six flat surfaces that extend circumferentially with respect to the opening in a generally hexagonal shape. The wrench opening also includes six pairs of flat surfaces respectively located adjacent the six circumferentially extending flat surfaces with the flat surfaces of each pair located adjacent opposite ends of the associated circumferentially extending flat surface. Six pairs of curved engagement surfaces of the wrench opening are respectively associated with the six circumferentially extending flat surfaces. Each pair of curved engagement surfaces connects the associated circumferentially extending flat surface and the pair of flat surfaces at its opposite ends. Each curved engagement surface has opposite ends that are respectively tangent with the circumferentially extending flat surface and the pair of flat surfaces connected thereby. The curved engagement surfaces engage the conventionally toleranced hexagonal fastener without any engagement of the hexagonal fastener by the flat surfaces. Connecting surfaces of the wrench opening connect the six pairs of flat surfaces with each other.

The construction of each embodiment of the closed wrench opening with the curved engagement surfaces connecting the associated flat surfaces permits economical manufacturing of the wrench in a manner which has not been previously possible while still permitting the desirable surface-to-surface engagement of the curved engagement surfaces with the conventionally toleranced hexagonal fastener so as to prevent deformation of the fastener upon torquing thereof by the wrench.

In its preferred construction, the "six-point" wrench embodiment has its wrench opening provided with a radius $R_1$ between the central axis and the midpoints of the six circumferentially extending flat surfaces. The curved engagement surfaces each have a radius $R_2$ which is less than 2.6 $R_1$. In its most preferred construction, the radius $R_2$ is in the range of about 0.2 R to 1.0 $R_1$.

The "six-point" wrench embodiment also preferably has its connecting surfaces provided with a curved shape. In one version, the curved connecting surfaces have a greater curvature than the curved engagement surfaces In another version, the curved connecting surfaces have a radius whose center of curvature is located at the central axis of the wrench opening.

In the "six-point" wrench embodiment, each of the six circumferentially extending flat surfaces has extensions each of which defines an acute angle of less than 11 degrees with the adjacent flat surface of the associated pair of flat surfaces. Most preferably, this acute angle is provided with extension of the tangent a size in the range of about 3 degrees to 9 degrees.

The "six-point" wrench embodiment has its wrench opening provided with opposite axial ends along the central axis with at least one axial end of the wrench opening being open to receive the hexagonal fastener. In one version, the curved engagement surfaces have a generally constant curvature in an axial direction from the one open axial end toward the other axial end. In another version the curved engagement surfaces have an increasing curvature in an axial direction from the one open axial end toward the other axial end.

In another embodiment of the wrench, the wrench opening has a "twelve-point" construction and includes a body defining a closed wrench opening that has a central axis and is of a nominal size for torquing a conventionally toleranced hexagonal fastener such as a bolt or nut head of the same nominal size. The wrench opening includes twelve pairs of flat surface having pointed shapes that project inwardly toward the central axis. The wrench opening also includes twelve curved engagement surfaces that respectively connect the flat surfaces of each pair at the inner extremity of its pointed shape. Each curved engagement surface has opposite ends that are respectively tangent with the associated pair of flat surfaces. These curved engagement surfaces engage the conventionally toleranced hexagonal fastener without any engagement of the hexagonal fastener by the flat surfaces. Connecting surfaces of the wrench opening connect the twelve pairs of flat surfaces with each other.

The "twelve-point" wrench embodiment preferably has its wrench opening provided with a radius $R_1$ between the central axis and mid-points of tangents between adjacent curved engagement surfaces. These curved engagement surfaces preferably have a radius $R_2$ that is less than 2.6 $R_1$ and most preferably in the range of about 0.2 $R_1$ to 1.0 $R_1$.

The "twelve-point" wrench embodiment preferably has its connecting surfaces of the wrench opening provided with curved shapes. In one version, the curved connecting surfaces of the wrench opening have a greater curvature than the curved engagement surfaces. In another version, the curved connecting surfaces have a radius $R_3$ whose center is located at the central axis.

In the "twelve-point" wrench embodiment, a tangent between adjacent curved engagement surfaces of the wrench opening has an extension that defines an acute angle of less than 11 degrees with each adjacent flat surface. This acute angle is most preferably provided with a size in the range of about 3 degrees to 9 degrees.

The "twelve-point" embodiment of the wrench has opposite axial ends along the central axis with at least one of the axial ends of the wrench opening being open to receive the hexagonal fastener. In one version, the curved engagement surfaces have a generally constant curvature in an axial direction from said one open axial end toward the other axial end. In another version, the curved engagement surfaces have an increasing curvature in an axial direction from said one open axial end toward the other axial end.

The construction of each embodiment of the closed wrench opening with the curved engagement surfaces connecting the associated flat surfaces permits economical manufacturing of the wrench in a manner which has not been previously possible while still permitting the desirable surface-to-surface engagement of the curved engagement surfaces with the conventionally toleranced hexagonal fastener so as to prevent deformation of the fastener upon torquing thereof by the wrench.

Both the "six-point" and "twelve-point" constructions of the closed wrench opening are each disclosed as being incorporated in socket and closed-end wrenches. With the socket version of each construction of the wrench opening, the curved engagement surfaces may have a constant curvature along the axial length of the wrench opening or may have an increasing curvature in an axial direction from an open axial end of the socket that receives the hexagonal fastener toward the closed end of the socket at which an opening or formation is provided to receive a driving tang such as on any type of conventional ratchet wrench. In the closed-end wrench version of each construction of the wrench opening, the curved engagement surfaces may have a constant curvature along the axial length of the wrench opening or may have an increasing curvature in an axial direction from each open axial end thereof toward the axial midplane of the wrench opening.

The objects, features, and advantages of the present invention are readily apparent from the following detailed description of the best modes for carrying out the invention when taken in connection with the accompanying drawings.

BRIEF DESCRIPTION OF DRAWINGS

FIG. 1 is a perspective view of a socket type wrench which includes a closed wrench opening in accordance with the present invention and illustrated with a "six-point" construction;

FIG. 2 is an end view of the socket wrench taken along the direction of line 2—2 in FIG. 1;

FIG. 3 is partially broken away side view of the socket wrench taken in section along the direction of line 3—3 in FIG. 2;

BEST MODES FOR CARRYING OUT THE INVENTION

Figure 4:
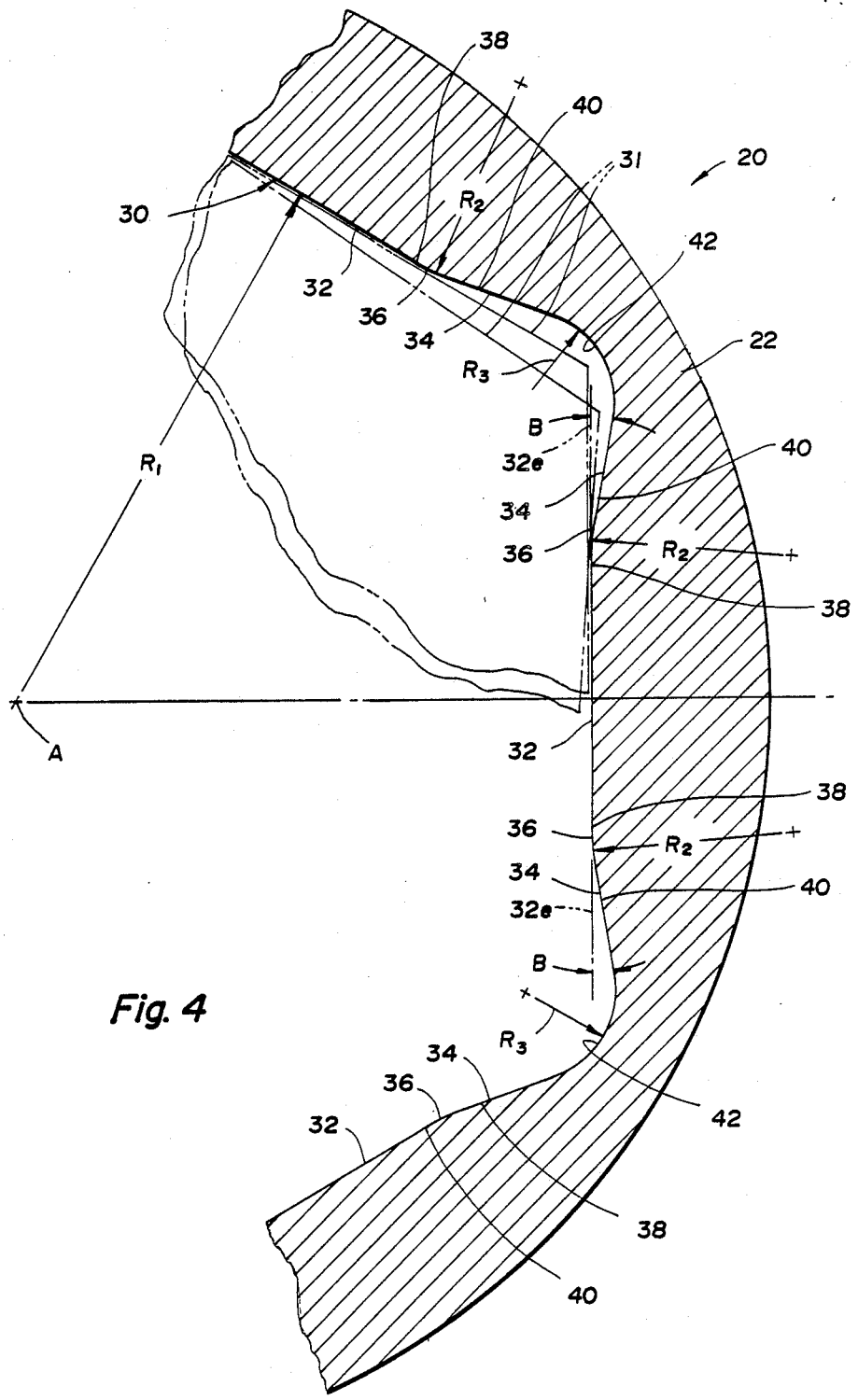
FIG. 4 is an enlarged partial view of the socket wrench taken along the direction of line 4—4 in FIG. 3 to illustrate the construction of the closed wrench opening.

With reference to FIGS. 1–3 of the drawings, a socket type wrench embodying the invention is indicated generally by 20 and includes a metal body 22 having a driven end 24 and a driving end 26. At its driven end, the wrench body 22 includes a formation or square opening 28 for receiving a square driving tang such as the tang of a reversible ratchet wrench of any conventional type to rotate the wrench. At its driving end 26, the wrench body 22 defines a closed wrench opening 30 of a "six-point" construction that has a central axis A and is constructed in accordance with the present invention. This wrench opening 30 is of any nominal size for torquing a conventionally toleranced hexagonal fastener 31 such as a nut or bolt head of the same nominal size.

The wrench opening 30 includes six flat surfaces 32 that extend circumferentially with respect to the opening in a generally hexagonal shape. Wrench opening 30 also includes six pairs of flat surfaces 34 respectively located adjacent the six circumferentially extending flat surfaces 32 with the flat surfaces 34 of each pair located adjacent opposite ends of the associated circumferentially extending flat surface 32. Six pairs of curved engagement surfaces 36 of the wrench opening are respectively associated with the six circumferentially extending flat surfaces 32. Each pair of curved engagement surfaces 36 connects the associated circumferentially extending flat surface 32 and the pair of flat surfaces 34 at its opposite ends. Each of the curved engagement surfaces 36 has opposite ends that are respectively tangent with the circumferentially flat surface 32 and the pair of flat surfaces 34 connected by the curved engagement surface. During torquing, the curved engagement surfaces 36 engage the conventionally toleranced hexagonal fastener 31 without any engagement of the hexagonal fastener by the flat surfaces 32 and 34. Connecting surfaces 42 of the wrench opening connect the six pairs of flat surfaces 34 with each other as is hereinafter more fully described.

The construction of the wrench opening 30 illustrated in FIGS. 2 and 4 with the flat surfaces 32 and 34 and the curved engagement surfaces 36 is economical to manufacture as well as being capable of continued manufacturing within the necessary tolerance range to provide the engagement of the curved engagement surfaces with a hexagonal fastener during the torquing of the hexagonal fastener. Furthermore, the curved engagement surfaces 36 increase the surface-to-surface engagement with the hexagonal fastener and thereby distribute the torque applied so as not to deform the fastener.

In the preferred construction of the wrench 20, the wrench opening 30 has a radius $R_1$ between the central axis A and midpoints of the circumferentially extending flat surfaces 32 whose ends connect with the adjacent ends 30 of the curved engagement surfaces. Each of the curved engagement surfaces 36 has an end 38 connected to the adjacent flat surface 32 an end 40 connected to the adjacent flat surface 34. Each curved engagement surface 36 has a radius $R_2$ preferably constructed so as to be less than 2.6 $R_1$ and most preferably in the range of about 0.2 $R_1$ to 1.0 $R_1$.

The construction of the wrench opening 30 as illustrated in FIGS. 2 and 4 has its connecting surfaces 42 curved with a greater curvature than the curved engagement surfaces 36 and these surfaces are disclosed as being tangent with the outer ends of flat surfaces 34 and as having a constant curvature with a radius $R_3$ which is thus less than the radius $R_2$ of the curved engagement surfaces.

Figure 15:
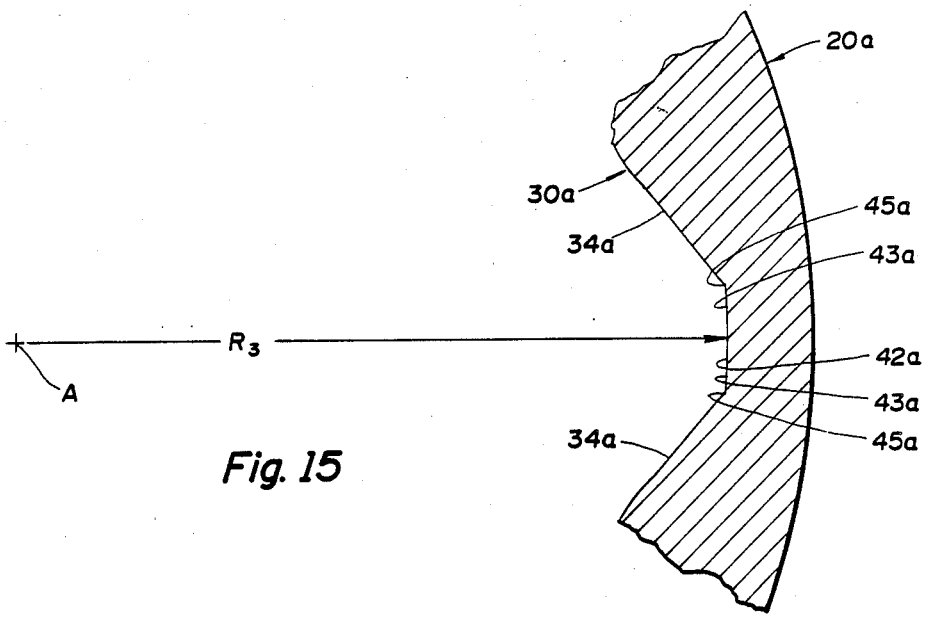
FIG. 15 is a partial sectional view taken in the same direction as FIG. 4 and illustrating another version of the "six-point" construction of the wrench opening.

As illustrated in FIG. 15, another version of the "six-point" socket wrench is identified by 20*a* and is similar to the embodiment of FIGS. 1 through 4 except that the connecting surfaces 42*a* of its wrench opening 30*a* have ends 43*a* that are not tangent with the flat surfaces 34*a*. Rather, these connecting surfaces 42*a* are disclosed as including ends 43*a* having line junctions 45*a* with the surfaces 34*a*. Preferably, the connecting surfaces 42*a* are curved and have a constant curvature with a radius $R_3$ whose center is at the central axis A.

As best illustrated in FIG. 4, each circumferentially extending flat surface 32 has an extension 32*e* that defines an acute angle B of less than 11 degrees with each flat surface 34. The acute angle B defined by the extension 32*e* of the tangent between adjacent curved engagement surfaces 36 and each adjacent flat surface 34 most preferably has a size in the range of about 3 degrees to 9 degrees.

With combined reference to FIGS. 3 and 4, the closed wrench opening 30 has opposite axial ends 44 and 46 along the central axis A with the end 44 closed in accordance with conventional socket construction and with the end 46 open to receive the hexagonal fastener to be torqued. The curved engagement surfaces 36 of this version have the same curvature at each axial location along the axial length of the wrench opening.

Figure 5:
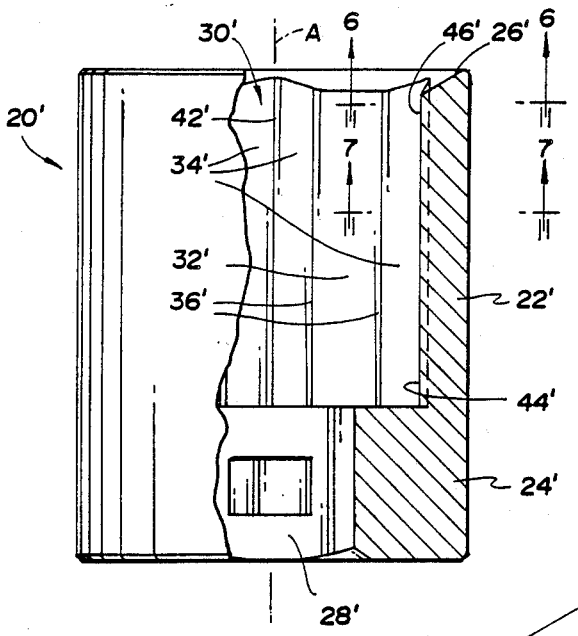
FIG. 5 is a partially broken away view similar to the view of FIG. 3 of a modified version of the socket wrench which has engagement surfaces whose curvatures change along the axial length of the wrench opening.
Figure 6:
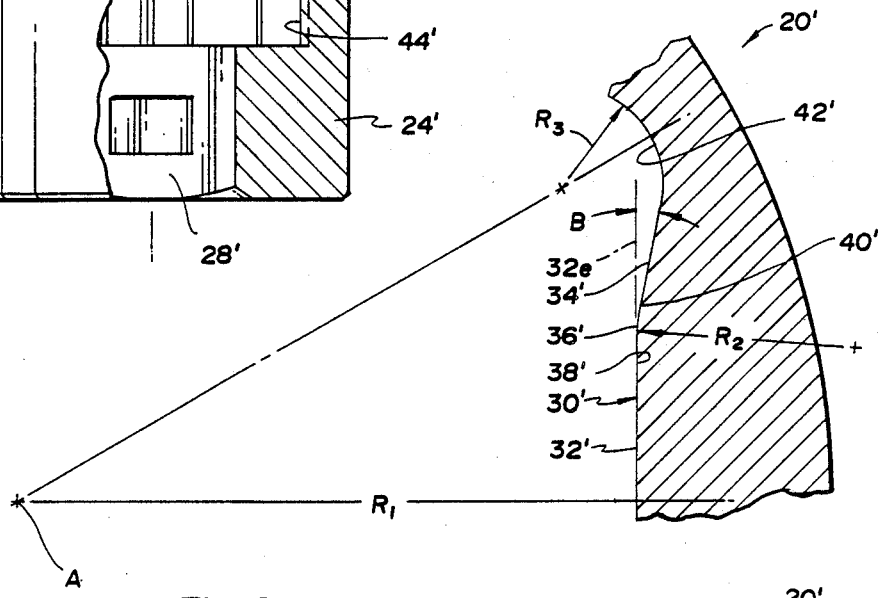
FIG. 6 is a partial sectional view of the socket wrench taken along the direction of line 6—6 in FIG. 5 to illustrate the curvature of the curved engagement surfaces adjacent the axial open end of the socket wrench.
Figure 7:
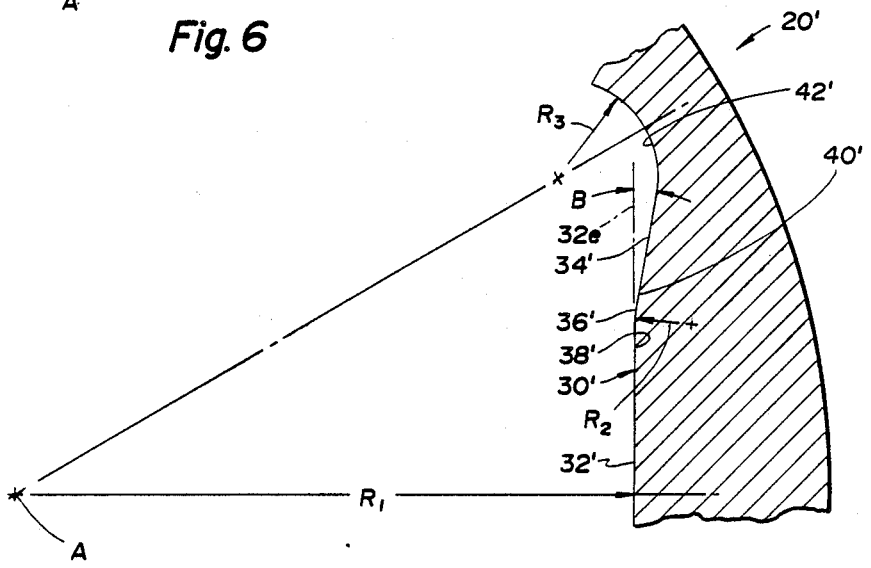
FIG. 7 is partial sectional view of the socket wrench taken along the direction of line 7—7 in FIG. 5 to illustrate the greater curvature of the curved engagement surfaces in a direction away from the axial open end of the socket wrench.

In the embodiment of the socket wrench 20' illustrated by FIGS. 5, 6 and 7, the wrench opening 30' provided by body 22' has curved engagement surfaces 36' which connect its six circumferentially extending flat surfaces 32' and its six pairs of flat surfaces 34'. Each curved engagement surface 36' has an increasing curvature in an axial direction from adjacent the driving wrench end 26' and the one open axial end 46' of the wrench opening 30' toward the other closed end 44' adjacent driven end 24' where the tang formation or opening 28' is located. Thus, with each engagement surface 36' having constant curvature at each axial location as illustrated by radius $R_2$, this radius $R_2$ decreases in length from the open axial end 46' toward the closed axial end 44'. Such a construction facilitates the insertion of the open axial end 46' of the wrench opening over the hexagonal fastener to be torqued while permitting the wrench opening to more closely grip the hexagonal fastener at a location toward the other closed end 44' such that less "free swing" is present upon torquing the fastener. Also, if the wrench is only partially inserted over the hexagonal fastener, the open end 46' has the curved engagement surfaces 36' provided with lesser curvature so more surface-to-surface engagement is present to distribute the torque on the portion of the fastener that is engagement by the wrench. Furthermore, the connecting surfaces 42' of the wrench opening 30' connect the flat surfaces 32' and 34' as with the wrench 20 and have the same curved construction previously described.

Figure 8:
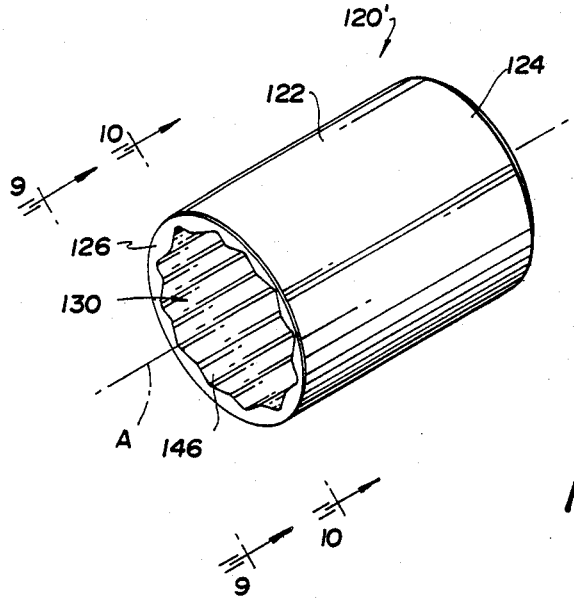
FIG. 8 is a perspective view of another embodiment of a socket type wrench which has a closed wrench opening according to the present invention and is illustrated with a "twelve-point" construction.
Figure 9:
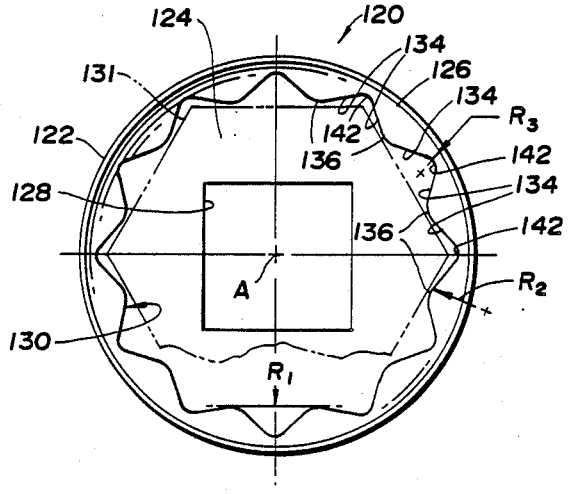
FIG. 9 is an end view of the socket wrench taken along the direction of line 9—9 in FIG. 8 to illustrate the construction of the closed wrench opening.
Figure 10:
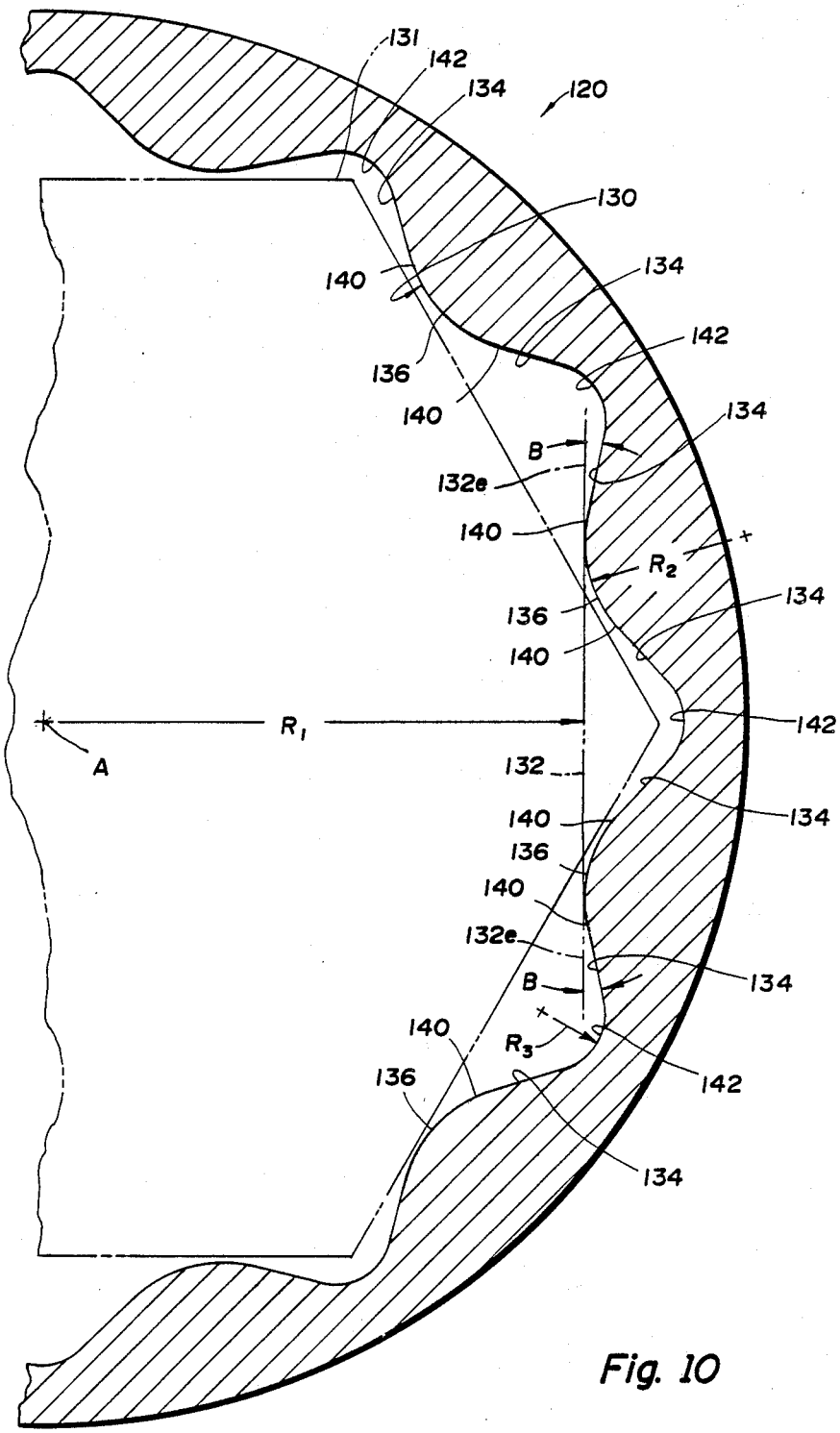
FIG. 10 is an enlarged partial view of the socket wrench taken in section along the direction of line 10—10 in FIG. 8 to illustrate the construction of the closed wrench opening.

With reference to FIGS. 8 through 10, another embodiment of a socket type wrench 120 is similar to the previously described socket wrenches 20 and 20' but has its closed wrench opening 130 provided with a "twelve-point" construction rather than a "six-point" construction as previously described. Otherwise, this socket wrench 120 is of the same construction including a wrench body 122 having a driven end 124, a driving end 126, and a central axis A. This socket wrench 120 also has a formation or square opening 128 adjacent its driven end 124 for providing driving of the socket wrench by the tang of a reversible ratchet wrench in a conventional manner. Adjacent the driving end 126, the wrench has the wrench opening 130 of a nominal size for torquing a conventionally toleranced hexagonal fastener such as a nut or bolt head of the same nominal size.

The closed wrench opening 130 of the socket wrench 120 shown in FIGS. 8 through 11 has twelve pairs of flat surfaces 134 having pointed shapes that project inwardly toward the central axis A. Twelve curved engagement surfaces 136 of the wrench opening 130 respectively connect the flat surfaces 134 of each pair. Each of the curved engagement surfaces 136 has opposite ends 140 that are respectively tangent with the associated pair of flat surfaces 134. The curved engagement surfaces 136 engage the conventionally toleranced hexagonal fastener 31 without any engagement of the hexagonal fastener by the flat surfaces 134. Connecting surfaces 142 of the wrench opening 130 connect the twelve pairs of flat surfaces 134 with each other.

The "twelve-point" construction of the wrench opening 130 like the "six-point" construction previously described can be economically manufactured due to the manner in which the flat surfaces are connected by the curved engagement surfaces. Furthermore, the manufacturing can be continued within the required tolerance for a greatly extended lifetime of a set of tooling as compared to manufacturing of other wrench opening constructions.

As illustrated in FIG. 10, a tangent **132*e* between adjacent curved engagement surfaces 136** has a midpoint which has a radius $R_1$ from the central axis A. Each of the engagement surfaces preferably has a radius $R_2$ which is less than 2.6 $R_1$ and most preferably in the range of about 0.2 $R_1$ to 1.0 $R_1$.

As shown by combined reference to FIGS. 9 and 10, the wrench opening 130 preferably has its connecting surfaces 142 provided with curved shapes and have a greater curvature than the curved engagement surfaces 136. Thus, when both curved surfaces 136 and 142 have a constant curvature, the radius $R_2$ of the curved engagement surfaces 136 will be greater than the radius $R_3$ of the curved connecting surfaces 142.

Figure 16:
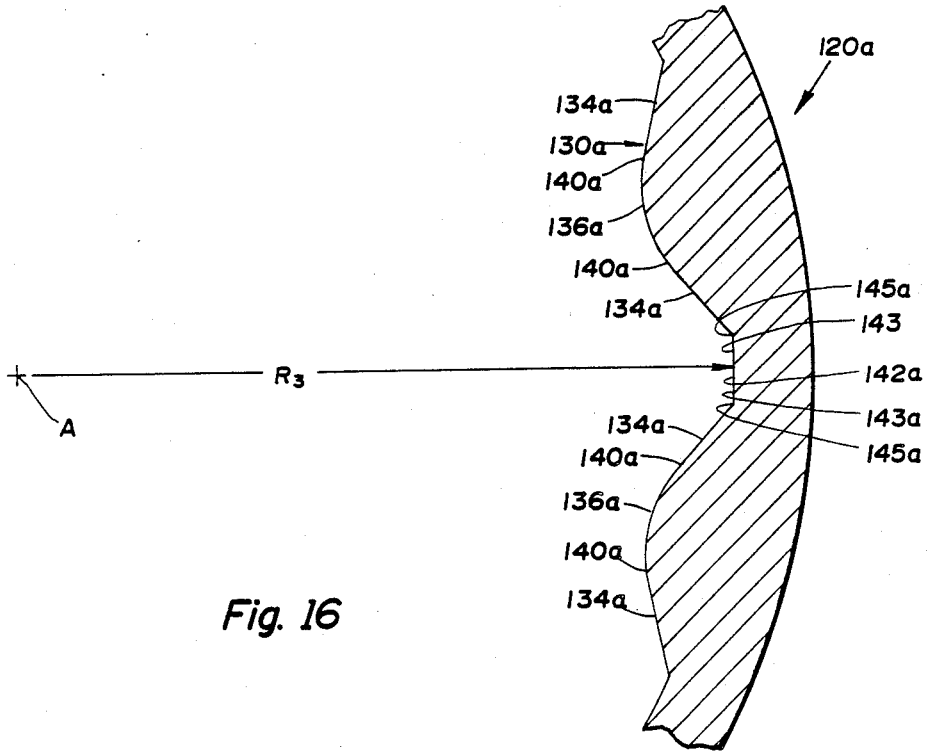
FIG. 16 is a partial sectional view taken in the same direction as FIG. 10 and illustrating another version of the "twelve-point" construction of the wrench opening.

As shown in FIG. 16, another version of the "twelve-point" socket wrench is identified by **120*a* and has a wrench opening similar to the embodiment of FIGS. 8 through 10 except that its connecting surfaces 142*a* do not have ends tangent with the flat surfaces 134*a*. Rather, the connecting surfaces 142*a* are shown as having ends 143*a* having line junctions 145*a* with the outer ends of the flat surfaces 134*a*. At their inner ends 140*a*, the flat surfaces 134*a* are connected by the curved engagement surfaces 136*a* like in the embodiment of FIGS. 8 through 11. Preferably, the connecting surfaces 142*a*** are curved and have a constant curvature with a radius $R_3$ whose center is at the central axis A.

As best illustrated in FIG. 10, the tangent 132 between each adjacent pair of curved engagement surfaces 136 has an extension **132*e* that defines an acute angle B of less than 11 degrees with the adjacent flat surface 134. Most preferably, the acute angle B defined by the extension 132*e* of the tangent between the adjacent curved engagement surfaces 136 and each adjacent flat surface 134** has a size in the range of about 3 degrees to 9 degrees.

With reference to FIG. 8, the wrench opening 130 has opposite axial ends along the central axis A, in a similar manner to the previously described "six-point" embodiment of FIGS. 1 through 4, and has its axial end 146 open to receive the hexagonal fastener to be torqued by the wrench. Each curved engagement surface 136 has the same curvature at each axial location along the length of the wrench opening.

Figure 12:
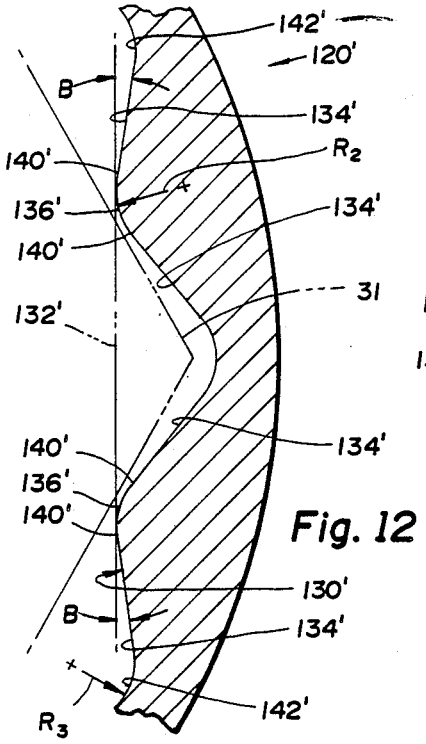
FIG. 12 is an enlarged partial view of the socket wrench taken in section along the direction of line 12—12 in FIG. 11 to illustrate the manner in which the engagement surface curvature changes to provide a greater curvature in a direction away from the axial open end of the socket as compared to the curvature more adjacent thereto.
Figure 11:
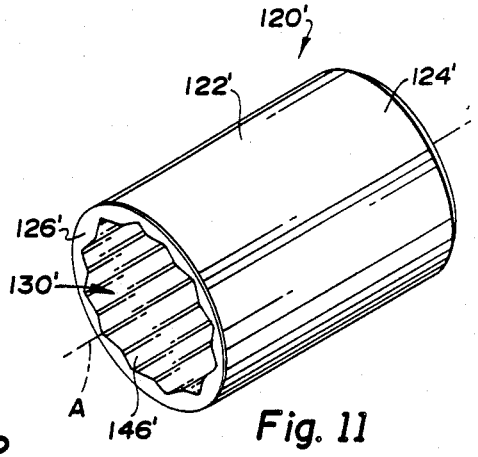
FIG. 11 is a perspective view of another embodiment of a socket type wrench which has a closed wrench opening of a "twelve-point" construction as in the embodiment of FIGS. 8 through 10 but with curved engagement surfaces whose curvature changes along the axial length of the opening.

Another embodiment of the wrench 120' illustrated in FIGS. 11 and 12 has the same construction as the embodiment of FIGS. 8 through 10 and thus has corresponding primed referenced numerals. However, the embodiment of FIGS. 11 and 12 has its curved engagement surfaces 136' provided with an increasing curvature in an axial direction from the open axial end 146' toward the other axial end of the opening. More specifically as illustrated in FIG. 12, the radius $R_2$ of each curved engagement surface 136' decreases in a direction away from the open axial end of the wrench opening 130' toward its other axial end. As previously mentioned, this construction of the wrench opening facilitates the initial insertion of the wrench opening 130' over the hexagonal fastener to be torqued while still providing close tolerance gripping with minimal "free swing" as well as providing greater surface-to-surface contact even when the wrench is only partially inserted over the fastener.

Figure 13:
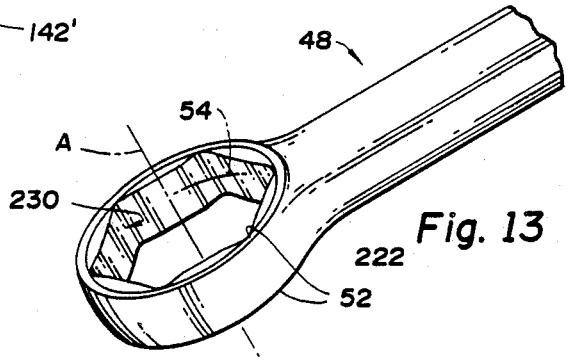
FIG. 13 is a partial perspective view of a closed-end wrench which has a closed wrench opening according to the present invention with a "six-point" construction like the socket type wrench illustrated in FIGS. 1 through 7.
Figure 14:
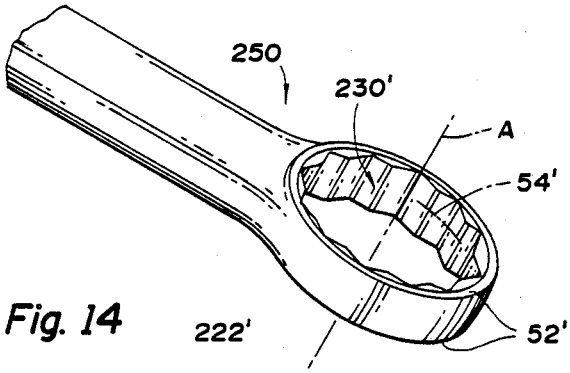
FIG. 14 is a partial perspective view of a closed-end wrench which has a closed wrench opening according to the present invention with a "twelve-point" construction like the socket type wrenches illustrated in FIGS. 8 through 11.

It should also be appreciated that it is possible to utilize the wrench opening of the present invention with closed-end wrenches as well as with socket type wrenches shown in FIGS. 1 through 12. More specifically, as illustrated in FIG. 13, a closed end wrench 48 is illustrated as having a wrench end body 222 defining a "six-point" wrench opening 230 of the same general construction as the "six-point" wrench opening described previously in connection with the socket wrench embodiment of FIGS. 1 through 7. Likewise, as illustrated in FIG. 13, a closed-end wrench 50 is illustrated as having a wrench end body 222' defining a "twelve-point" wrench opening 230' of generally the same construction as the "twelve-point" wrench opening illustrated in FIGS. 8 through 12. Each of the closed-end wrenches 48 and 50 has oppositely oriented axial faces 52, 52' between which the curved engagement surfaces have increasing curvature in an axial direction from each wrench head facing 52, 52' toward an axial midplane 54, 54' of the wrench opening. In all other respects, the wrench openings 230 and 230' are the same as the previously described embodiments such that the prior description is applicable and need not be repeated.

While the best modes for carrying out the invention have been described in detail, those familiar with the art to which this invention relates will recognize various alternatives, designs and embodiments for practicing the invention as defined by the following claims.

What is claimed is:

1. A wrench including a body defining a closed wrench opening that has a central axis and is of a nominal size for torquing a conventionally toleranced hexagonal fastener such as a nut or bolt head of the same nominal size, said wrench opening comprising: first six flat surfaces that extend circumferentially with respect to the opening in a generally hexagonal shape; six pairs of second flat surfaces respectively located adjacent the six circumferentially extending first flat surfaces with the second flat surfaces of each pair located adjacent opposite ends of the associated circumferentially extending first flat surface; six pairs of curved engagement surfaces respectively associated with the six circumferentially extending first flat surfaces; each pair of curved engagement surfaces connecting the associated circumfentially extending first flat surface and the pair of second flat surfaces at opposite ends thereof; each curved engagement surface having opposite ends that are respectively tangent with the circumferentially extending first flat surface and the pair of second flat surfaces connected thereby; the curved engagement surfaces engaging the conventionally toleranced hexagonal fastener without any engagement of the hexagonal fastener by the first and second flat surfaces; and connecting surfaces that connect the six pairs of second flat surfaces with each other.

2. A wrench as in claim 1 whose wrench opening has a radius $R_1$ between the central axis and midpoints of the six circumferentially extending first flat surfaces, the curved engagement surfaces having a radius $R_2$, and the radius $R_2$ being less than 2.6 $R_1$.

3. A wrench as in claim 2 wherein the radius $R_2$ is in the range of about 0.2 $R_1$ to 1.0 $R_1$.

4. A wrench as in claim 1 wherein the connecting surfaces of the wrench opening are curved.

5. A wrench opening as in claim 4 wherein the curved connecting surfaces of the wrench opening have a greater curvature than the curved engagement surfaces.

6. A wrench as in claim 4 wherein the curved connecting surfaces have a radius $R_3$ whose center is located at the central axis.

7. A wrench as in claim 1 wherein each of the six circumferentially extending first flat surfaces has extensions each of which defines an acute angle of less than 11 degrees with the adjacent second flat surface of the associated pair of second flat surfaces.

8. A wrench as in claim 7 wherein the wrench opening has said acute angle is provided with a size in the range of about 3 degrees to 9 degrees.

9. A wrench as in claim 1 wherein the wrench opening has opposite axial ends along the central axis, at least one of the axial ends of the wrench opening being open to receive the hexagonal fastener, and the curved engagement surfaces having a generally constant curvature in an axial direction from said one open axial end toward the other axial end.

10. A wrench as in claim 1 wherein the wrench opening has opposite axial ends along the central axis, at least one of the axial ends of the wrench opening being open to receive the hexagonal fastener, and the curved engagement surfaces having an increasing curvature in an axial direction from said one open axial end toward the other axial end.

11. A wrench as in claim 1 which comprises a socket wrench including a body having a driven end and a driving end, said driven end including a formation by which the socket wrench is rotated, and the driving end defining the closed wrench opening.

12. A wrench as in claim 1 which comprises a socket wrench including a body having a driven end and a driving end, said driven end including a formation by which the socket wrench is rotated, the driving end defining the closed wrench opening, said wrench opening having an open axial end at the driving end of the body, and the curved engagement surfaces having an increasing curvature in a direction from the open axial end of the wrench opening toward the driven end of the body.

13. A wrench including a wrench as in claim 1 which comprises a closed-end wrench including a wrench end body defining the closed wrench opening.

14. A wrench as in claim 1 which comprises a closed-end wrench including a wrench end body defining the closed wrench opening which has opposite axial ends, and the curved engagement surfaces having an increasing curvature in a direction from at least one axial end of the wrench opening toward the other axial end of the opening.

15. A closed-end wrench as in claim 14 wherein the curved engagement surfaces have increasing curvature in a direction from each axial end of the wrench opening toward the other.

16. A socket wrench comprising: a wrench body having a driven end including a formation for rotating the wrench and having an open driving end defining a closed wrench opening that has a central axis and is of a nominal size for torquing a conventionally toleranced hexagonal fastener such as a nut or bolt head of the same nominal size; said wrench opening including six pairs of first flat surfaces that extend circumferentially with respect to the opening in a generally hexagonal shape; said wrench opening including six pairs of second flat surfaces respectively located adjacent the six circumferentially extending first flat surfaces with the second flat surfaces of each pair located adjacent opposite ends of the associated circumferentially extending first flat surface; said wrench opening including six pairs of curved engagement surfaces respectively associated with the six circumferentially extending first flat surfaces; each pair of curved engagement surfaces connecting the associated circumferentially extending first flat surface and the pair of second flat surfaces at opposite ends thereof; each curved engagement surface having opposite ends that are respectively tangent with the circumferentially extending first flat surface and pair of second flat surfaces connected thereby; the curved engagement surfaces having an increasing curvature in a direction from the open driving end of the wrench body toward the driven end of the body and engaging the conventionally toleranced hexagonal fastener without any engagement of the hexagonal fastener by the first and second flat surfaces; and said wrench opening including curved connecting surfaces that connect the six pairs of second flat surfaces with each other.

17. A closed-end wrench comprising: a wrench end body having opposite axial ends and defining a closed wrench opening that has a central axis; said wrench opening being of a nominal size for torquing a conventionally toleranced hexagonal fastener such as a nut or bolt head of the same nominal size; said wrench opening including six first flat surfaces that extend circumferentially with respect to the opening in a generally hexagonal shape; said wrench opening including six pairs of second flat surfaces respectively located adjacent the six circumferentially extending first flat surfaces with the second flat surfaces of each pair located adjacent opposite ends of the associated circumferentially extending first flat surface; said wrench opening including six pairs of curved engagement surfaces respectively associated with the six circumferentially extending first flat surfaces; each pair of curved engagement surfaces connecting the associated circumferentially extending first flat surface and the pair of second flat surfaces at opposite ends thereof; each curved engagement surface having opposite ends that are respectively tangent with the circumferentially extending first flat surface and the pair of second flat surfaces connected thereby; the curved engagement surfaces having an increasing curvature in a direction from each axial end of the body toward the other and engaging the conventionally toleranced hexagonal fastener without any engagement of the hexagonal fastener by the first and second flat surfaces; and said wrench opening including curved connecting surfaces that connect the six pairs of second flat surfaces with each other.

18. A wrench including a body defining a closed wrench opening that has a central axis and is of a nominal size for torquing a conventionally toleranced hexagonal fastener such as a nut or bolt head of the same nominal size, said wrench opening comprising: twelve pairs of flat surfaces having pointed shapes that project inwardly toward the central axis; twelve curved engagement surfaces that respectively connect the flat surface of each pair at the inner extremity of its pointed shape; each curved engagement surface having opposite ends that are respectively tangent with the associated pair of flat surfaces; the curved engagement surfaces engaging the conventionally toleranced hexagonal fastener without any engagement of the hexagonal fastener by the flat surfaces; and connecting surfaces that connect the twelve pairs of flat surfaces with each other.

19. A wrench as in claim 18 whose wrench opening has a radius $R_1$ between the central axis and midpoints of tangents between adjacent curved engagement surfaces, the curved engagement surfaces having a radius $R_2$, and the radius $R_2$ being less than 2.6 $R_1$.

20. A wrench opening as in claim 19 wherein the radius $R_2$ is in the range of about 0.2 $R_1$ to 1.0 $R_1$.

21. A wrench as in claim 18 wherein the connecting surfaces of the wrench opening are curved.

22. A wrench opening as in claim 21 wherein the curved connecting surfaces of the wrench opening have a greater curvature than the curved engagement surfaces.

23. A wrench as in claim 21 wherein the curved connecting surfaces have a radius $R_3$ whose center is located at the central axis.

24. A wrench as in claim 18 wherein a tangent between adjacent curved engagement surfaces of the wrench opening has an extension that defines an acute angle of less than 11 degrees with each adjacent flat surface.

25. A wrench as in claim 24 wherein the wrench opening has said acute angle provided with a size in the range of about 3 degrees to 9 degrees.

26. A wrench as in claim 18 wherein the wrench opening has opposite axial ends along the central axis, at least one of the axial ends of the wrench opening being open to receive the hexagonal fastener, and the curved engagement surfaces having a generally constant curvature in an axial direction from said one open axial end toward the other axial end.

27. A wrench as in claim 18 wherein the wrench opening has opposite axial ends along the central axis, at least one of the axial ends of the wrench opening being open to receive the hexagonal fastener, and the curved engagement surfaces having an increasing curvature in an axial direction from said one open axial end toward the other axial end.

28. A wrench as in claim 18 which comprises a socket wrench including a body having a driven end and a driving end, said driven end including a formation by which the socket wrench is rotated, the driving end defining the closed wrench opening.

29. A wrench as in claim 18 which comprises a socket wrench including a body having a driven end and a driving end, said driven end including a formation by which the socket wrench is rotated, the driving end defining the closed wrench opening, and the curved engagement surfaces having an increasing curvature in an direction from the open axial end of the wrench opening toward the driven end of the body.

30. A wrench as in claim 18 which comprises a closed-end wrench including a wrench end body defining the closed wrench opening.

31. A wrench as in claim 18 which comprises a closed-end wrench including a wrench end body defining the closed wrench opening which has opposite axial ends, and the curved engagement surfaces having an increasing curvature in a direction from at least one axial end of the wrench opening toward the other axial end of the wrench opening.

32. A closed-end wrench as in claim 30 wherein the curved engagement surfaces have increasing curvature in a direction from each axial end of the wrench opening toward the other.

33. A socket wrench comprising: a wrench body having a driven end including a formation for rotating the wrench and having an open driving end defining a closed wrench opening that has a central axis and is of a nominal size for torquing a conventionally toleranced hexagonal fastener such as a nut or bolt head of the same nominal size, said wrench opening including twelve pairs of flat surfaces having pointed shapes that project inwardly toward the central axis; said wrench opening including twelve curved engagement surfaces that respectively connect the flat surfaces of each pair at the inner extremity of its pointed shape; each curved engagement surface having opposite ends that are respectively tangent with the associated pair of flat surfaces; the curved engagement surfaces having an increasing curvature in a direction from the open driving end of the wrench body toward the driven end of the body and engaging the conventionally toleranced hexagonal fastener without any engagement of the hexagonal fastener by the flat surfaces; and said wrench opening including curved connecting surfaces that connect the twelve pairs of flat surfaces with each other.

34. A closed-end wrench comprising: a wrench end body including a body having opposite axial ends and defining a nominal size for torquing a conventionally toleranced hexagonal fastener such as a nut or bolt head of the same nominal size; said wrench opening including twelve pairs of flat surfaces having pointed shapes that project inwardly toward the central axis; said wrench opening including twelve curved engagement surfaces that respectively connect the flat surfaces of each pair at the inner extremity of its pointed shape; each curved engagement surface having opposite ends that are respectively tangent with the associated pair of flat surfaces; the curved engagement surfaces having an increasing curvature in a direction from each axial end of the body toward the other and engaging the conventionally toleranced hexagonal fastener without any engagement of the hexagonal fastener by the flat surfaces; and said wrench opening including curved connecting surfaces that connect the twelve pairs of flat surfaces with each other.

* * * * *

UNITED STATES PATENT AND TRADEMARK OFFICE

CERTIFICATE OF CORRECTION

PATENT NO. : 4,930,378

DATED : June 5, 1990

INVENTOR(S) : David S. Colvin

It is certified that error appears in the above-identified patent and that said Letters Patent is hereby corrected as shown below:

Column 2, line 67, ".2 R" should be --.2 $R_1$--.

Column 3, line 31, "surface" should be --surfaces--.

Signed and Sealed this

Sixth Day of August, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,930,378
DATED : June 5, 1990
INVENTOR(S) : David S. Colvin

It is certified that error appears in the above-identified patent and that said Letters Patent is hereby corrected as shown below:

Drawing:

Delete Fig. 4, and substitute therefor Fig. 4, as shown on the attached sheet.

Signed and Sealed this

Twenty-sixth Day of August, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,930,378

DATED : June 5, 1990

INVENTOR(S) : David S. Colvin

It is certified that error appears in the above-indentified patent and that said Letters Patent is hereby corrected as shown below:

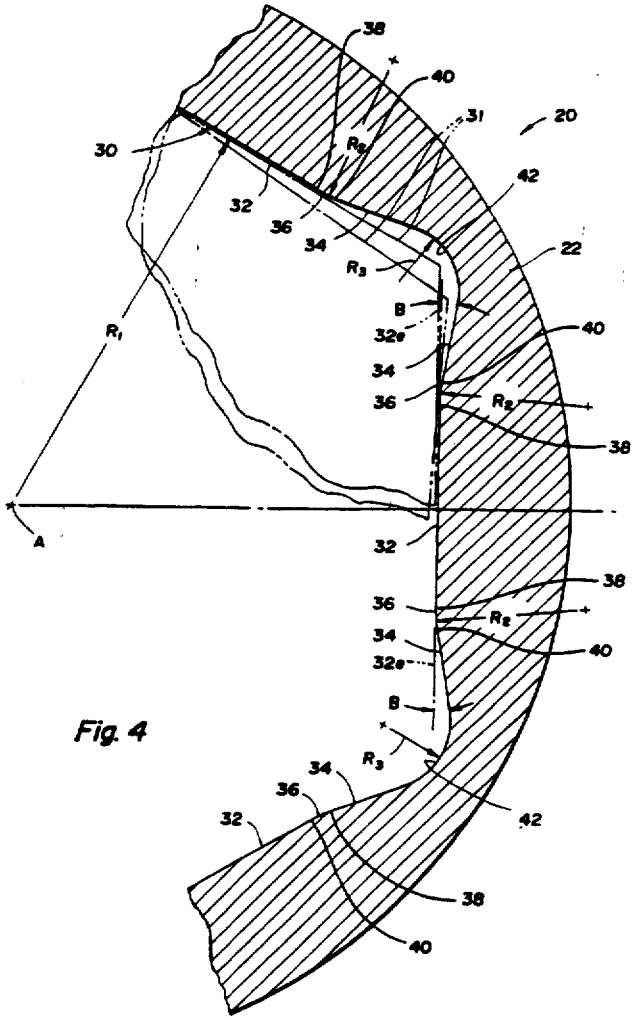

Fig. 4